US006423670B2

(12) United States Patent
Locke et al.

(10) Patent No.: US 6,423,670 B2
(45) Date of Patent: Jul. 23, 2002

(54) LUBRICATING OIL COMPOSITIONS

(75) Inventors: Christopher J. Locke; Isabel P. MacDonald, both of Oxon (GB)

(73) Assignee: Infineum International Ltd. (GB)

( * ) Notice: Subject to any disclaimer, the term of this patent is extended or adjusted under 35 U.S.C. 154(b) by 80 days.

(21) Appl. No.: 09/808,081

(22) Filed: Mar. 14, 2001

(30) Foreign Application Priority Data

Mar. 20, 2000 (EP) ..... 00200997

(51) Int. Cl.[7] ..... C10M 141/10; C10M 141/12

(52) U.S. Cl. ..... 508/192; 508/364; 508/365; 508/372; 508/380; 508/398; 508/586

(58) Field of Search ..... 508/192, 364, 508/398, 365, 372, 380, 586

(56) References Cited

U.S. PATENT DOCUMENTS

| | | | | | |
|---|---|---|---|---|---|
| 2,719,125 | A | | 9/1955 | Roberts | 252/46.7 |
| 2,719,126 | A | | 9/1955 | Fields et al. | 252/47 |
| 3,087,932 | A | | 4/1963 | Little | 260/302 |
| 3,087,936 | A | | 4/1963 | Le Suer | 260/326.3 |
| 3,254,025 | A | | 5/1966 | Le Suer | 252/32.7 |
| 3,275,554 | A | | 9/1966 | Wagenaar | 252/50 |
| 3,442,808 | A | | 5/1969 | Traise et al. | 252/49.6 |
| 3,565,804 | A | | 2/1971 | Honnen et al. | 252/50 |
| 3,821,236 | A | | 6/1974 | Ripple | 260/302 SD |
| 3,904,537 | A | | 9/1975 | Ripple | 252/47.5 |
| 3,966,621 | A | | 6/1976 | Watkins et al. | 252/42.7 |
| 4,097,387 | A | | 6/1978 | Caspari | 252/47.5 |
| 4,107,059 | A | | 8/1978 | King et al. | 252/28 |
| 4,136,043 | A | | 1/1979 | Davis | 252/47.5 |
| 4,188,299 | A | | 2/1980 | Caspari | 252/46.4 |
| 4,193,882 | A | | 3/1980 | Gemmill | 252/47.5 |
| 4,938,880 | A | | 7/1990 | Waddoups | 252/32.7 |
| 5,141,657 | A | * | 8/1992 | Fetterman, Jr. et al. | 508/363 |
| 5,202,036 | A | * | 4/1993 | Ripple et al. | 508/363 |
| 5,225,092 | A | | 7/1993 | Emert et al. | 252/50 |
| 5,320,765 | A | * | 6/1994 | Fetterman, Jr. et al. | 50/363 |
| 5,523,007 | A | | 6/1996 | Kristen et al. | 252/32.7 E |
| 5,558,802 | A | | 9/1996 | Dowling | 508/391 |
| 5,719,107 | A | * | 2/1998 | Outten et al. | 508/185 |
| 5,726,133 | A | * | 3/1998 | Blahey et al. | 508/390 |
| 6,004,910 | A | * | 12/1999 | Bloch et al. | 508/294 |
| 6,140,279 | A | * | 10/2000 | Emert et al. | 508/192 |

FOREIGN PATENT DOCUMENTS

| | | | |
|---|---|---|---|
| EP | 0 330 522 B1 | 8/1989 | C10M/161/00 |
| EP | 0 528 610 A1 | 2/1993 | C10M/141/10 |
| EP | 0 686 689 A2 | 12/1995 | C10M/141/10 |
| GB | 1 560 830 | 2/1980 | C07D/285/04 |
| WO | WO95/29976 | 11/1995 | C10M/163/00 |
| WO | WO96/01885 | 1/1996 | C10M/163/00 |
| WO | WO98/44079 | 10/1998 | C10M/141/10 |

* cited by examiner

*Primary Examiner*—Jacqueline V. Howard

(57) ABSTRACT

A heavy duty diesel engine lubricating oil composition having no more than 0.10 wt. % phosphorus comprises an ashless dispersant, a neutral calcium phenate, an overbased calcium or magnesium sulfonate, a metal dihydrocarbyldithiophosphate, and a phenolic or aminic antioxidant.

9 Claims, No Drawings

LUBRICATING OIL COMPOSITIONS

The present invention relates to a crankcase lubricant which exhibits superior performance properties in heavy duty (HD) diesel (compression ignited) internal combustion engines whilst being a low phosphorus formulation. Such lubricants may be referred to variously as lubricating oils, lubricating oil compositions, and lubricating oil formulations.

The heavy duty trucking market has come to adopt the diesel engine as its preferred power source due to both its excellent longevity and its economy of operation. Specialized lubricants have been developed to meet the more stringent performance requirements of HD diesel engines compared with passenger car engines.

Several engine tests are required to demonstrate satisfactory HD performance, including the following:

Sequence IIIE (ASTM D553) test for antioxidancy as measured by viscosity increase.

Daimler Chrylser OM364LA diesel engine test for bore polish, piston cleanliness, cylinder wear, engine sludge and oil consumption.

Cummins M11 test to evaluate soot-related valve train wear, filter plugging and sludge.

Thus, there is a need in the art for lubricating oils that are capable of meeting the HD diesel requirements. Surprisingly, a low phosphorus lubricating oil which affords improved performance in the Sequence IIIE, OM364LA and Cummins M11 tests has now been discovered. Thus, the present invention is directed, in a first aspect, towards a heavy duty diesel engine lubricating oil composition comprising a major amount of an oil of lubricating viscosity to which has been added:

(a) a lubricating oil borated or non-borated ashless dispersant which has not more than 0.3, for example not more than 0.2, such as not more than 0.1, mass % boron, in a minor amount;

(b) an oil-soluble neutral calcium phenate detergent in a minor amount;

(c) an oil-soluble overbased calcium or magnesium sulfonate or mixture thereof present in a minor amount so that not more than 0.1, for example not more than 0.05, such as not more than 0.025, mass % magnesium is present in the composition;

(d) a metal dihydrocarbyldithiophosphate present in such an amount that the phosphorus content of the composition is from 0.025 to 0.10, such as 0.05 to 0.07 or to 0.08, mass %; and (e) a antioxidant phenolic or aminic, preferably a hindered phenol, in a minor amount, the composition being free of any neutral metal sulfonate and any other neutral metal detergent, other than the phenate (b).

As used herein, all mass % numbers are on an active ingredient basis unless otherwise noted, and are based on elemental boron, magnesium or phosphorus in respect of (a), (c) and (d) above as appropriate.

The composition is preferably free of aminic, such as aromatic amine, antioxidants.

A major amount means in excess of 50 mass % of the composition and a minor amount means less than 50 mass % of the composition, both in respect of the stated additive, and in respect of the total mass % of all of the additives present in the composition.

It will be understood that the additives of the composition may react under the conditions of formulation, storage, or use and that the invention also provides the product obtainable or obtained as a result of any such reaction.

The word "comprises" or comprising", or cognate words, when used in this specification, is taken to specify the presence of stated features, integers, steps or components but does not preclude the presence or addition of one or more other features, integers, steps, or components.

In a second aspect, the invention is directed towards a concentrate for blending with an oil of lubricating viscosity to provide a heavy duty diesel engine lubricating oil composition, said concentrate comprising:

(a) a lubricating oil borated or non-borated ashless dispersant which has not more than 0.3, for example not more than 0.2, such as not more than 0. 1, mass % boron;

(b) an oil-soluble neutral calcium phenate detergent;

(c) an oil-soluble overbased calcium or magnesium sulfonate or mixture thereof present in such an amount so that not more than 0.3 mass % magnesium is present in the concentrate;

(d) a metal dihydrocarbyldithiophosphate present in such amount so that the phosphorus content of the concentrate is up to 0.7 mass %; and (e) a phenolic or aminic, preferably a hindered phenol, antioxidant, the concentrate being free of any neutral metal sulfonate and any other neutral metal detergent, other than the phenate (b).

In a third aspect, the invention is directed towards a method of lubricating a heavy duty diesel engine which comprises supplying to the crankcase thereof a lubricating oil composition according to the first aspect of the invention.

In the fourth aspect, the invention is directed towards the use in a crankcase lubricating oil composition of a combination of additives (a) to (e) according to the first aspect of the invention to achieve adequate performance in one or more of the following tests for crankcase lubricating oils:

Sequence IIIE (ASTM D553) for antioxidancy;

Daimler Chrysler OM364LA for bore polish, piston cleanliness, cylinder wear, engine sludge, and oil consumption;

Cummins M11 for soot-related valve train wear, filter plugging and sludge.

In a fifth respect, the invention is directed towards a combination comprising (i) moveable, contacting mechanical parts to be lubricated of a heavy duty diesel internal combustion engine; and (ii) a lubricating oil composition according to the first aspect of the invention.

The features of the invention will now be discussed in further detail as follows.

Lubricating Oil

The oil of lubricating viscosity may be selected from any of the synthetic or natural oils used as crankcase lubricating oils for heavy duty diesel (compression-ignited) engines. The oil of lubricating viscosity conveniently has a viscosity of 2.5 to 12, preferably 2.5 to 9, $mm^2/s$ at 100° C. Mixtures of synthetic and natural base oils may be used if desired.

Dispersant (a)

The ashless dispersant comprises an oil-soluble polymeric hydrocarbon backbone having functional groups that are capable of associating with particles to be dispersed. Dispersants may be present in amounts of from 2 to 10, preferably 3 to 5, mass %. Typically, the dispersants comprise amine, alcohol, amide, or ester polar moieties attached to the polymer backbone often via a bridging group. The dispersant may be, for example, selected from oil-soluble salts, esters, amino-esters, amides, imides, and oxazolines of long chain hydrocarbon substituted mono and dicarboxylic acids or their anhydrides; thiocarboxylate derivatives of long chain hydrocarbons; long chain aliphatic hydrocarbons having a polyamine attached directly thereto; and Mannich condensation products formed by condensing a long chain substituted phenol with formaldehyde and polyalkylene polyamine, and Koch reaction products.

The oil-soluble polymeric hydrocarbon backbone is typically an olefin polymer, especially polymers comprising a major molar amount (i.e. greater than 50 mole %) of a $C_2$ to $C_{18}$ olefin (e.g., ethylene, propylene, butylene, isobutylene, pentene, octene-1, styrene), and typically a $C_2$ to $C_5$ olefin. The oil-soluble polymeric hydrocarbon backbone may be a homopolymer (e.g., polypropylene or polyisobutylene) or a copolymer of two or more of such olefins (e.g., copolymers of ethylene and an alpha-olefin such as propylene and butylene or copolymers of two different alpha-olefins).

One preferred class of olefin polymers is polybutenes and specifically polyisobutenes (PIP,) or poly-n-butenes, such as may be prepared by polymerization of a $C_4$ refinery stream. Another preferred class of olefin polymers is ethylene alpha-olefin (EAO) copolymers or alpha-olefin homo- and copolymers such as may be prepared using metallocene chemistry having in each case a high degree (e.g.>30%) of terminal vinylidene unsaturation.

The oil-soluble polymeric hydrocarbon backbone will usually have number average molecular weight ($\overline{M}n$) within the range of from 300 to 20,000. The $\overline{M}n$ of the backbone is preferably within the range of 500 to 10,000, more preferably 700 to 5,000 where the use of the backbone is to prepare a component having the primary function of dispersancy. Hetero polymers such as polyepoxides are also usable to prepare components. Both relatively low molecular weight ($\overline{M}n$ 500 to 1500) and relatively high molecular weight ($\overline{M}n$ 1500 to 5,000 or greater) polymers are useful to make dispersants. Particularly useful olefin polymers for use in dispersants have $\overline{M}n$ within the range of from 900 to 3000. Where the component is also intended to have a viscosity modification effect it is desirable to use higher molecular weight, typically with $\overline{M}n$ of from 2,000 to 20,000, and if the component is intended to function primarily as a viscosity modifier then the molecular weight may be even higher with an $\overline{M}n$ of from 20,000 up to 500,000 or greater. The functionalized olefin polymers used to prepare dispersants preferably have approximately one terminal double bond per polymer chain.

The $\overline{M}n$ for such polymers can be determined by several known techniques. A convenient method for such determination is by gel permeation chromatography (GPC) which additionally provides molecular weight distribution information.

The oil-soluble polymeric hydrocarbon backbone may be functionalized to incorporate a functional group into the backbone of the polymer, or as one or more groups pendant from the polymer backbone. The functional group typically will be polar and contain one or more hetero atoms such as P, O, S, N, halogen, or boron. It can be attached to a saturated hydrocarbon part of the oil soluble polymeric hydrocarbon backbone via substitution reactions or to an olefinic portion via addition or cycloaddition reactions. Alternatively, the functional group can be incorporated into the polymer in conjunction with oxidation or cleavage of the polymer chain end (e.g., as in ozonolysis).

Useful functionalization reactions include: halogenation of the polymer allylic to the olefinic bond and subsequent reaction of the halogenated polymer with an ethylenically unsaturated functional compound (e.g., maleation where the polymer is reacted with maleic acid or anhydride); reaction of the polymer with an unsaturated functional compound by the "ene" reaction absent halogenation; reaction of the polymer with at least one phenol group (this permits derivatization in a Mannich base-type condensation); reaction of the polymer at a point of unsaturation with carbon monoxide using a hydroformylation catalyst or a Koch-type reaction to introduce a carbonyl group attached to a —$CH_2$— or in an iso or neo position; reaction of the polymer with the functionalizing compound by free radical addition using a free radical catalyst; reaction with a thiocarboxylic acid derivative; and reaction of the polymer by air oxidation methods, epoxidation, chloroamination, or ozonolysis.

The functionalized oil-soluble polymeric hydrocarbon backbone is then further derivatized with a nucleophilic reactant such as an amine, amino-alcohol, alcohol, metal compound or mixture thereof to form a corresponding derivative. Useful amine compounds for derivatizing functionalized polymers comprise at least one amine and can comprise one or more additional amine or other reactive or polar groups. These amines may be hydrocarbyl amines or may be predominantly hydrocarbyl amines in which the hydrocarbyl group includes other groups, e.g., hydroxy groups, alkoxy groups, amide groups, nitrites, imidazoline groups, and the like. Particularly useful amine compounds include mono- and polyamines, e.g. polyalkylene and polyoxyalkylene polyamines of about 2 to 60, conveniently 2 to 40 (e.g., 3 to 20) total carbon atoms and about 1 to 12, conveniently 3 to 12, and preferably 3 to 9 nitrogen atoms in the molecule. Mixtures of amine compounds may advantageously be used such as those prepared by reaction of alkylene dihalide with ammonia. Preferred amines are aliphatic saturated amines, including, e.g., 1,2-diaminoethane; 1,3-diaminopropane; 1,4-diaminobutane; 1,6-diaminohexane; polyethylene amines such as diethylene triamine; triethylene tetramine; tetraethylene pentamine; and polypropyleneamines such as 1 ,2-propylene diamine; and di-(1,3-propylene) triamine.

A preferred group of dispersants includes those substituted with succinic anhydride groups and reacted with polyethylene amines (e.g., tetraethylene pentamine), aminoalcohols such as trismethylolaminomethane, polymer products of metallocene catalyzed polymerisations, and optionally additional reactants such as alcohols and reactive metals e.g., pentaerythritol, and combinations thereof). Also useful are dispersants wherein a polyamine is attached directly to the backbone by the methods shown in U.S. Pat. Nos. 5,225,092, 3,275,554 and 3,565,804 where a halogen group on a halogenated hydrocarbon is displaced with various alkylene polyamines.

Another class of dispersants comprises Mannich base condensation products. Generally, these are prepared by condensing about one mole of an alkyl-substituted mono- or polyhydroxy benzene with about 1 to 2.5 moles of carbonyl compounds (e.g., formaldehyde and paraformaldehyde) and about 0.5 to 2 moles polyalkylene polyamine as disclosed, for example, in U.S. Pat. No. 3,442,808.

The dispersant can be further post-treated by a variety of conventional post treatments such as boration, as generally taught in U.S. Pat. Nos. 3,087,936 and 3,254,025. This is readily accomplished by treating an acyl nitrogen-containing dispersant with a boron compound selected from the group consisting of boron oxide, boron halides, boron acids and esters of boron acids or highly borated low $\overline{M}w$ dispersant, in an amount to provide a boron to nitrogen mole ratio of 0.01 to 3.0.

Preferred for use in the invention is a polyisobutenyl succinimide dispersant wherein the Mn of the polyisobutenyl groups is from 1500 to 3000, such as 2000 to 2300, or a borated derivative thereof which contains not more than 0.3, for example not more than 0.2, such as not more than 0.1, for example 0.01 to 0.1, mass % boron, as elemental boron.

Calcium Phenates (b)

The lubricant oil of the present invention includes a neutral calcium phenate. "Neutral" means the phenate contains a substantially stoichiometric amount of metal. Conveniently, the phenate will be used in amounts from 0.3 to 1.5, preferably from 0.3 to 0.8, more preferably from 0.45 to 0.65, mass %. For example, alkylated calcium phenates and preferably sulfurized alkylated calcium phenates are included in the present invention. Such salts are readily obtainable in the art. Methods for preparing phenates are disclosed in, for example U.S. Pat. No. 3,966,621.

Calcium salts of phenols and sulfurized phenols may be prepared by reaction with an appropriate metal compound such as an oxide or hydroxide and neutral. Sulfurised phenols may be prepared by reacting a phenol with sulfur or sulfur-containing compounds such as hydrogen sulfide, sulfur monohalide or sulfur dihalide, to form products which are generally mixtures of compounds in which two or more phenols are bridged by sulfur-containing bridges.

The neutral calcium phenate used in the oils of the invention is, as stated above, the sole neutral metal detergent in the composition of the present invention which is free of other neutral metal detergent additives.

Overbased Calcium or Magnesium Sulfonate (c)

The compositions of the instant invention also include, as stated, oil-soluble overbased calcium or magnesium sulfonate or both; an amount of 0.2 to 2 mass % is preferred. Also as stated, the compositions of the present invention do not contain more than 0.05 mass % magnesium; 0.03 to 0.05 mass % magnesium is preferred or not more than 0.025 mass % magnesium.

Metal-containing or ash-forming sulfonate detergents function both as detergents to reduce or remove deposits and as acid neutralizers or rust inhibitors, thereby reducing wear and corrosion and extending engine life. Detergents generally comprise a polar head with a long hydrophobic tail, with the polar head comprising a metal salt of an acidic organic compound. It is possible to include large amounts of a metal base by reacting an excess of a metal compound such as an oxide or hydroxide with an acidic gas such as carbon dioxide. The resulting overbased detergent sulfonate comprises neutralised detergent as the outer layer of a metal base (e.g. carbonate) micelle. Such overbased sulfonate detergents may have a TBN of 150 or greater, and typically of from 250 to 450 or more.

Preferred are oil-soluble overbased calcium and magnesium sulfonates having TBN's of 300 and 400, respectively.

Sulfonates may be prepared from sulfonic acids which are typically obtained by the sulfonation of alkyl-substituted aromatic hydrocarbons such as those obtained from the fractionation of petroleum or by the alkylation of aromatic hydrocarbons. Examples included those obtained by alkylating benzene, toluene, xylene, naphthalene, diphenyl or their halogen derivatives such as chlorobenzene, chlorotoluene and chloronaphthalene. The alkylation may be carried out in the presence of a catalyst with alkylating agents having from 3 to more than 70 carbon atoms. The alkaryl sulfonates usually contain from 9 to 80 or more, preferably from 16 to 60, carbon atoms per alkyl-substituted aromatic moiety.

The oil-soluble sulfonates or alkyl aryl sulfonic acids may be neutralized with oxides, hydroxides, alkoxides, carbonates, carboxylate, sulfides, hydrosulfides, nitrates, borates and ethers of the metal. The amount of metal compound is chosen having regard to the desired TBN of the final product but typically ranges from 125 to 220 mass % of that stoichiometrically required.

Metal Dihydrocarbyldithiophosphate (d)

Dihydrocarbyl dithiophosphate metal salts are frequently used as anti-wear and antioxidant agents. The compositions of this invention preferably contain a metal dihydrocarbyl dithiophosphate in an amount such that from 0.05 to 0.10, such as 0.05 to 0.07 or to 0.08, mass % phosphorus is present in the finished lubricating oil. The metal may be an alkali or alkaline earth metal, or aluminum, lead, tin, molybdenum, manganese, nickel or copper, but zinc salts are preferred and may be present in amounts of 0.1 to 1.5, preferably 0.5 to 1.0, mass %, based upon the total weight of the lubricating oil composition. They may be prepared in accordance with known techniques by first forming a dihydrocarbyl dithiophosphoric acid (DDPA), usually by reaction of one or more alcohol or a phenol with $P_2S_5$ and then neutralizing the formed DDPA with a zinc compound. For example, a dithiophosphoric acid may be made by reacting mixtures of primary and secondary alcohols. Alternatively, multiple dithiophosphoric acids can be prepared where the hydrocarbyl groups on one are entirely secondary in character and the hydrocarbyl groups on the others are entirely primary in character. To make the zinc salt, any basic or neutral zinc compound could be used, but the oxides, hydroxides and carbonates are most generally employed.

Commercial additives frequently contain an excess of zinc due to use of an excess of the basic zinc compound in the neutralization reaction.

The preferred zinc dihydrocarbyl dithiophosphates are oil-soluble salts of dihydrocarbyl dithiophosphoric acids and may be represented by the following formula:

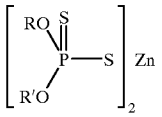

wherein R and R' may be the same or different hydrocarbyl radicals containing from 1 to 18, preferably 2 to 12, carbon atoms and including radicals such as alkyl, alkenyl, aryl, arylalkyl, alkaryl and cycloaliphatic radicals. Particularly preferred as R and R' groups are alkyl groups of 2 to 8 carbon atoms. Thus, the radicals may, for example, be ethyl, n-propyl, i-propyl, n-butyl, i-butyl, sec-butyl, amyl, n-hexyl, i-hexyl, n-octyl, decyl, dodecyl, octadecyl, 2-ethylhexyl, phenyl, butylphenyl, cyclohexyl, methylcyclopentyl, propenyl, butenyl. In order to obtain oil-solubility, the total number of carbon atoms (i.e. R and R') in the dithiophosphoric acid will generally be about 5 or greater. The zinc dihydrocarbyl dithiophosphate can therefore comprise zinc dialkyl dithiophosphates. Conveniently at least 50 mole % of the alcohols used to introduce hydrocarbyl groups into the dithiophosphoric acids are secondary alcohols.

Greater percentages of secondary alcohols are preferred, and may be required in particularly high nitrogen systems. Thus, the alcohols used to introduce the hydrocarbyl groups may be 60 or 75 mole % secondary. Most preferably, the hydrocarbyl groups are more than 90 mole % secondary. Metal dithiophosphates that are secondary in character give better wear control in tests such as the Sequence VE (ASTM D5302) and the GM 6.2L tests.

Phenolic or Aminic Antioxidants (e)

The lubricant of this invention, for example, includes 0.1 to 1.5, preferably about 0.2 to 1.0, mass %, of an antioxidant (e). Hindered phenols are preferred and are generally oil-soluble phenols substituted at one or both ortho positions. Suitable compounds include monohydric and mononuclear phenols such as 2,6-di-tertiary alkylphenols (e.g. 2,6-di-t-butylphenol, 2,4,6-tri-t-butyl phenol, 2-t-butyl phenol, 4-alkyl, 2,6-t-butyl phenol, 2,6-di-isopropylphenol, and 2,6-dimethyl, 4-t-butyl phenol).

Other suitable hindered phenols include polyhydric and polynuclear phenols such as alkylene-bridged hindered phenols (4,4-methylenebis(6-tert-butyl-o-cresol), 4,4'-methylenebis (2-tert-amyl-o-cresol), and 2,2'-methylenebis (2,6-di-t-butylphenol). The hindered phenol may be borated or sulfurized. Preferred hindered phenols have good oil-solubility and relatively low volatility.

As examples of amimic antioxidants, there may be mentioned aromatic amine antioxidants having at least two aromatic groups attached directly to the nitrogen. Although these materials may be used in small amounts, preferred embodiments of the present invention are free of these compounds. These aromatic amines have been found to impact soot-induced viscosity increases. They are preferably used in only small amounts, or more preferably avoided altogether other than such amounts as may result as an impurity from another component of the composition.

Typical oil-soluble aromatic amines having at least two aromatic groups attached directly to one amine nitrogen contain from 6 to 16 carbon atoms. The amines may contain more than two aromatic groups. Compounds having a total of at least three aromatic groups in which two aromatic groups are linked by a covalent bond or by an atom or group (e.g., an oxygen or sulfur atom, or a —CO—, —$SO_2$— or alkylene group) and two aromatic groups are directly attached to one amine nitrogen are also considered aromatic amines having at least two aromatic groups attached directly to the nitrogen. The aromatic rings are typically substituted by one or more substituents selected from alkyl, cycloalkyl, alkoxy, aryloxy, acyl, acylamino, hydroxy, and nitro groups. These compounds should be minimized or avoided altogether. The amount of any such oil soluble aromatic amines having at least two aromatic groups attached directly to one amine nitrogen should preferably not exceed 0.2 mass %.

Co-Additives

Other additives may be present as optional ingredients in the composition of this invention and these are listed below.

Rust inhibitors selected from the group consisting of nonionic polyoxyalkylene polyols and esters thereof, polyoxyalkylene phenols, and anionic alkyl sulfonic acids may be used.

Copper-and lead-bearing corrosion inhibitors may be used, but are typically not required with the formulation of the present invention. Typically such compounds are the thiadiazole polysulfides containing from 5 to 50 carbon atoms, their derivatives and polymers thereof. Derivatives of 1,3,4 thiadiazoles such as those described in U.S. Pat. Nos. 2,719,125; 2,719,126; and 3,087,932 are typical. Other similar materials are described in U.S. Pat. Nos. 3,821,236; 3,904,537; 4,097,387; 4,107,059; 4,136,043; 4,188,299; and 4,193,882. Other additives are the thio and polythio sulfenamides of thiadiazoles such as those described in UK. Patent Specification No. 1,560,830. Benzotriazoles derivatives also fall within this class of additives. When these compounds are included in the lubricating composition, they are preferably present in an amount not exceeding 0.2 mass %.

A small amount of a demulsifying component may be used. A preferred demulsifying component is described in EP 330,522. It is obtained by reacting an alkylene oxide with an adduct obtained by reacting a bis-epoxide with a polyhydric alcohol. The demulsifier should be used at a level not exceeding 0.1, conveniently 0.001 to 0.05, mass %.

Pour point depressants, otherwise known as lube oil flow improvers, lower the minimum temperature at which the fluid will flow or can be poured. Such additives are well-known. Typical of those additives which improve the low temperature fluidity of the fluid are $C_8$ to $C_{18}$ dialkyl fumarate/vinyl acetate copolymers and polyalkylmethacrylates. Likewise, the dialkyl fumarate and vinyl acetate may be used as compatibilizing agents.

Incompatibility may occur when certain types of polymers for use in the manufacture of motor oil viscosity modifiers are dissolved in basestock. An uneven molecular dispersion of polymer which gives the mixture either a tendency to separate or a grainy appearance ensues. The problem is solved by using a compatibility agent having a hydrocarbon group attached to a functional group that serves to break up or prevent packing.

Foam control can be provided by many compounds including an antifoamant of the polysiloxane type, for example, silicone oil or polydimethyl siloxane.

Viscosity modifiers (VM's) function to impart high and low temperature operability to a lubricating oil. The VM used may have that sole function, or may be multifunctional.

Multifunctional viscosity modifiers that also function as dispersants are also known. Suitable viscosity modifiers are polyisobutylene, copolymers of ethylene and propylene and higher alpha-olefins, polymethacrylates, polyalkylmethacrylates, methacrylate copolymers, copolymers of an unsaturated dicarboxylic acid and a vinyl compound, inter polymers of styrene and acrylic esters, and partially hydrogenated copolymers of styrene/isoprene, styrene/butadiene, and isoprene/butadiene, as well as the partially hydrogenated homopolymers of butadiene and isoprene and isoprene/divinylbenzene.

Some of the above-mentioned additives can provide a multiplicity of effects; thus for example, a single additive may act as a dispersant-oxidation inhibitor.

It is important to note that addition of the other components noted above must comply with the limitations set forth herein.

Blends

To make lubricating compositions of the present invention, each additive is typically blended into the oil of lubricating viscosity, or base oil, in an amount which enables the additive to provide its desired function. Effective amounts of additives (a) to (e) have been described above. Representative amounts of other additives, stated as mass per cent active ingredient, are listed below:

| ADDITIVE | MASS (Broad) | % MASS % (Preferred) |
|---|---|---|
| Corrosion Inhibitor | 0–0.2 | 0–0.1 |
| Pour Point Depressant | 0.01–1 | 0.1–0.3 |
| Anti-Foaming Agent | 0.0005–0.005 | 0.001–0.004 |
| Supplemental Anti-wear Agents | 0–0.5 | 0–0.2 |
| Viscosity Modifier | 0–1.5 | 0–1.2 |
| Mineral or Synthetic Base Oil | Balance | Balance |

The additive components may be incorporated into a base oil in any convenient way. Thus, each additive can be added directly to the oil by dispersing or dissolving it in the oil at the desired level of concentration. Such blending may occur at ambient temperature or at an elevated temperature.

Preferably, all of the additives except for the viscosity modifier and the pour point depressant are blended into a concentrate that is subsequently blended into the base oil to make a finished lubricant. Use of such concentrates , or additives packages, is conventional. The concentrate will typically be formulated to contain the additive(s) in proper amounts to provide the desired concentration in the final formulation when the concentrate is combined with a predetermined amount of base lubricant.

Preferably the concentrate is made in accordance with the method described in U.S. Pat. No. 4,938,880. That patent describes making a premix of dispersant and metal detergents that is pre-blended at a temperature of at least about 100° C. Thereafter the pre-mix is cooled to at least 85° C. and the additional additives are added.

The final compositions may employ from 2 to 15, preferably 5 to 10, typically 7 to 8, mass % of the additive package(s), the remainder being base oil.

EXAMPLES

The invention is further described by way of illustration only by reference to the following examples. In the examples, unless otherwise stated, all percentages are reported as mass percent of active ingredient. Several oils were formulated and subjected to Sequence IIIE, OM364LA and M11 engine tests. Those oils identified by a letter A suffix are comparison oils and those oils identified by a number 1 suffix are oils of the invention. In each example:

The values represent the mass % of the indicated additive in each formulation, the balance of which comprised base oil, viscosity modifier, anti-foam additive and demulsifier.

"ZDDP" was zinc dialkyldithiophosphate, the alkyl groups being primary C8 and secondary C4.

The dispersant was a Mn 2225 polyisobutenyl succinimide dispersant, used borated to 0.14 mass % B in Examples 1 to 3 and unborated in Example 4.

indicates absence of component.

In the examples below:

provided 0.097 mass % P in the formulation provided 0.05 mass % Mg in the formulation provided 0.03 mass % Mg in the formulation

Example 1

| Additive | Oil 1-A | Oil 1-1 |
|---|---|---|
| Dispersant (Borated) | 3.240 | 4.860 |
| Neutral Ca Phenate | 0.391 | 0.598 |
| Neutral Ca Sulfonate | 0.484 | — |
| Phenol Antioxidant | 0.600 | 0.600 |
| ZDDP* | 0.915 | 0.914 |
| Overbased Mg Sulfonate** | 0.256 | 0.256 |
| Overbased Ca Sulfonate | 0.797 | 0.797 |

Sequence IIIE data for these two oils are below.

| | Oil 1-A | Oil 1-1 |
|---|---|---|
| Hours to 375% KV Increase | 68.8 | 76.1 |
| KV Increase at 64 hours | 237% (API CH-4 fail) | 98% (API CH-4 pass) |

"KV Increase" is the increase in kinematic viscosity measured at 40° C., less than 200% constituting a "pass". Oil 1-1 is an oil of the invention. Oil 1-A is for comparison. The data show the beneficial effect of employing neutral calcium phenate as the sole neutral detergent. The additional dispersant in Oil 1-1 has no effect on viscosity increase due to oxidation.

Example 2

| Additive | Oil 2-A | Oil 2-1 |
|---|---|---|
| Dispersant (Borated) | 3.240 | 4.212 |
| Neutral Ca Phenate | 0.391 | 0.598 |
| Neutral Ca Sulfonate | 0.484 | — |
| Phenol Antioxidant | 0.401 | 0.400 |
| ZDDP* | 0.915 | 0.916 |
| Overbased Mg Sulfonate** | 0.256 | 0.256 |
| Overbased Ca Sulfonate | 0.797 | 0.797 |

OM364LA data for these oils are below.

| | Oil 2-A | Oil 2-1 |
|---|---|---|
| Bore Polish, % | 5.6 (Poor) | 0.6 |
| Piston Cleanliness, Merits | 50.3 | 47.0 |
| Cylinder Wear, Average, Microns | 2.8 | 1.7 |
| Engine Sludge Average, Merits | 9.6 | 9.7 |
| Oil Consumption, kg. | 16.6 | 11.9 |

Oil 2-1 is an oil of the invention and shows the advantages attributable to a formulation which has calcium phenate as the sole neutral detergent. The additional dispersant in Oil 2-1 does not affect bore polish performance in the OM364LA test.

Example 3

| Additive | Oil 3-1 |
|---|---|
| Dispersant (Borated) | 4.212 |
| Neutral Ca Phenate | 0.598 |
| Phenol Antioxidant | 0.321 |
| ZDDP* | 0.915 |
| Overbased Mg Sulfonate*** | 0.171 |
| Overbased Ca Sulfonate | 0.797 |

***provided 0.03 mass % Mg in the formulation

Oil 3-1 contains less Mg than Oil 2-1. The OM364LA data for Oil 3-1 are below tabulated in comparison with the same data for Oil 2-1 of Example 2. Oil 3-1 shows the improvement resulting from the lowering of the Mg content in the bore polish value.

| | Oil 3-1 | Oil 2-1 |
|---|---|---|
| Bore Polish, % | 0.2 | 0.6 |
| Piston Cleanliness, Merits | 43.0 | 47.0 |
| Cylinder Wear, Average, Microns | 2.0 | 1.7 |
| Engine Sludge Average, Merits | 9.7 | 9.7 |
| Oil Consumption, kg. | 11.9 | 11.9 |

Example 4

| Additive | Oil 4-1 |
|---|---|
| Dispersant (Unborated) | 4.290 |
| Neutral Ca Phenate | 0.598 |
| Phenol Antioxidant | 0.321 |
| ZDDP* | 0.915 |
| Overbased Mg Sulfonate*** | 0.171 |
| Overbased Ca Sulfonate | 0.797 |

Cummins M11 test data for Oil 4-1 are tabulated below in comparison with data for Oil 3-1 as used in Example 3. These data show that, despite the absence of boron, wear control has been retained.

| | Oil 4-1 | Oil 3-1 |
|---|---|---|
| Oil Filter Delta Pressure, kPa | 54 | 63 |
| Crosshead Wear, mg. | 5.0 | 6.0 |
| Sludge, Merits | 8.9 | 9.2 |

What is claimed is:

1. A diesel engine lubricating oil composition comprising a major amount of oil of lubricating viscosity to which has been added:

(a) a lubricating oil ashless dispersant which has not more than 0.2 mass % boron;

(b) an oil-soluble neutral calcium phenate detergent;

(c) an oil-soluble overbased calcium or magnesium sulfonate or mixture thereof present in an amount such that not more than 0.05 magnesium is present in the composition;

(d) a metal dihydrocarbyldithiophosphate present in an amount such that the phosphorus content of the composition is from 0.025 to 0.10 mass %; and (e) a phenolic or aminic antioxidant in a minor amount the composition being free of neutral metal detergent, other than the phenate (b).

2. The composition of claim 1 wherein the dispersant is a polyisobutenyl succinimide lubricating oil dispersant where the polyisobutenyl has an Mn of 1500 to 3000.

3. The composition of claim 1 wherein there is present 0.3 to 1.5 mass % of the neutral calcium phenate.

4. The composition of claim 1 wherein there is present 0.2 to 2 mass % of the overbased calcium or magnesium sulfonate or mixture thereof.

5. The composition of claim 1 wherein the metal dihydrocarbyldithiophosphate is a zinc dialkyldithiophosphate where the alkyl groups have 2 to 8 carbon atoms.

6. A method of lubricating a compression ignited engine which comprises supplying to the crankcase thereof a lubricating oil composition of claim 1.

7. A concentrate for blending with an oil of lubricating viscosity to provide a diesel engine lubricating oil composition, said concentrate comprising:

(a) a lubricating oil ashless dispersant which has not more than 0.2 mass % boron;

(b) an oil-soluble neutral calcium phenate detergent;

(c) an oil-soluble overbased calcium or magnesium sulfonate or mixture thereof present in an amount such that not more than 0.3 mass % magnesium is present in the concentrate;

(d) a metal dihydrocarbyldithiophosphate present in an amount such that the phosphorus content of the concentrate is up to 0.7 mass %; and (e) a phenolic or aminic antioxidant, the concentrate being free of neutral metal detergent, other than the phenate (b).

8. The composition of claim 1, wherein antioxidant (e) is a hindered phenol.

9. The composition of claim 8 wherein there is present 0.1 to 1.5 mass % of antioxidant (e) in the form of a hindered phenol.

* * * * *